US006435953B2

(12) United States Patent
Ogawa

(10) Patent No.: US 6,435,953 B2
(45) Date of Patent: Aug. 20, 2002

(54) COIN CLEANING APPARATUS

(75) Inventor: Katuhiro Ogawa, Kobe (JP)

(73) Assignee: Kabushiki Kaisha J. Box, Kobe (JP)

( * ) Notice: Subject to any disclaimer, the term of this patent is extended or adjusted under 35 U.S.C. 154(b) by 0 days.

(21) Appl. No.: 09/872,470

(22) Filed: Jun. 1, 2001

(30) Foreign Application Priority Data

Jun. 2, 2000 (JP) ..... 2000-003766

(51) Int. Cl.[7] ..... B24B 31/00

(52) U.S. Cl. ..... 451/103; 451/109; 451/111; 134/6; 134/62; 134/67

(58) Field of Search ..... 451/103, 109, 451/111; 134/6, 9, 15, 32, 42, 62, 67

(56) References Cited

U.S. PATENT DOCUMENTS 4,546,572 A * 10/1985 Fischer ..... 451/194
5,538,562 A * 7/1996 Misaki ..... 134/6

OTHER PUBLICATIONS

Patent Abstracts of Japan, Patent Laid–Open Publication 10–277504.
Patent Abstracts of Japan, Patent Laid–Open Publication 10–286534.

* cited by examiner

*Primary Examiner*—M. Rachuba
(74) *Attorney, Agent, or Firm*—Friedrich Kueffner

(57) ABSTRACT

A coin cleaning and grinding apparatus includes a conveyor for conveying coins, two drive rollers of urethane sponge having a urethane hardness between 70 and 90 degrees, and a pair of primary grinding rollers and a pair of secondary grinding rollers of urethane sponge. The primary grinding rollers are supported rotatably and downstream from the conveyor. One of the primary grinding rollers is positioned lower than the other. The lower primary grinding roller is in compressive contact with the higher primary grinding roller and one of the drive rollers. The secondary grinding rollers are supported rotatably and downstream from the primary grinding rollers. One of the secondary grinding rollers is positioned lower than the other. The lower secondary grinding roller is in compressive contact with the higher secondary grinding roller and the other drive roller. A sprinkling plate is positioned at an angle above the grinding rollers. The sprinkling plate has sprinkling holes through which abrasive liquid can be sprinkled. The holes are formed above the grinding rollers, respectively, upstream from the axes of the grinding rollers, respectively. The sprinkling plate has drip-prevention grooves formed in its underside.

4 Claims, 7 Drawing Sheets

PRIOR ART

COIN CLEANING APPARATUS

BACKGROUND OF THE INVENTION

1. Field of the Invention

The present invention relates to apparatus for cleaning and grinding medals, coins or the like.

2. Description of the Related Art

FIG. 7 of the accompanying drawings shows a conventional apparatus exclusively used for cleaning coins. The apparatus includes a cleaning conveyor C for receiving coins K from a hopper (not shown) and conveying them upward to the left, as seen in FIG. 7. The apparatus also includes a pair of cleaning rollers S in mutual contact, which are mounted downstream from the front end of the conveyor C. The apparatus further includes a pair of squeeze (wringer) rollers P in mutual contact, which are mounted downstream from the cleaning rollers S. Each of the lower rollers S and P is in compressive contact with a drive roller D. The apparatus further includes a cleaning brush B rotatably mounted above the conveyor C. The cleaning brush B can be rotated counterclockwise in FIG. 7. The apparatus further includes a means M for supplying cleaning fluid, which is positioned over the brush B. The cleaning fluid is a mixture of a large amount of cold or hot water and a capful (10 cc) of cleaner. Such an apparatus is disclosed in Japanese Patent Laid-Open Publications 10-277504 and 10-286534.

While the conveyor C is conveying coins K, with the cleaning brush B scraping and aligning them, they are cleaned with the cleaning fluid supplied from the supplying means M. The cleaned coins K pass between the cleaning rollers S and between the squeeze rollers P, which wipe the liquid off the coins before the coins are discharged out of the apparatus. When the coins K pass between the cleaning rollers S and between the squeeze rollers P, metal powder or other foreign substances on the coins may be transferred to and stick to the cylindrical surfaces of the rollers. This soon decreases the ability of the roller surfaces to absorb water. As a result, the apparatus discharges wet coins K, which are apt to rust. It is therefore necessary to frequently remove and clean the rollers. Some cleaning apparatuses of this type include cleaning rollers and squeeze rollers easy to remove by hand. Other cleaning apparatuses of this type include cleaning rollers and squeeze rollers of a cassette type. It is still, however, troublesome work to remove and clean the rollers of these apparatuses. In addition, it is necessary to clean the flush tank of such an apparatus once a day. Furthermore, because the drive rollers D are made of stainless material, they are hard and may apply high pressure on the cleaning rollers S and squeeze rollers P, so that the rollers S and P may be damaged.

SUMMARY OF THE INVENTION

An object of the present invention is to provide a coin cleaning and grinding apparatus which operates without the problems that would arise if the cleaned coins were wiped by rollers. Another object is to provide an apparatus which includes rollers for grinding coins, wherein the rollers are cleaned constantly by being sprinkled directly with an abrasive liquid that does not rust coins, coins pass and are ground between the rollers, and wherein the rollers neither need frequently removing and cleaning, nor are damaged.

A coin cleaning and grinding apparatus according to the present invention includes a conveyor for conveying coins. The apparatus also includes first and second drive rollers mounted rotatably and horizontally in parallel with each other. The apparatus further includes a pair of primary grinding rollers and a pair of secondary grinding rollers. The grinding rollers are mounted rotatably and in parallel with the drive rollers. The primary grinding rollers are positioned downstream from the conveyor. One of the primary grinding rollers is positioned lower than the other. The lower primary grinding roller is in compressive contact with the higher primary grinding roller and the first drive roller. The secondary grinding rollers are positioned downstream from the primary grinding rollers. One of the secondary grinding rollers is positioned lower than the other. The lower secondary grinding roller is in compressive contact with the higher secondary grinding roller and the second drive roller. The apparatus further includes a sprinkling plate positioned at an angle above the grinding rollers. The sprinkling plate has first and second rows of sprinkling holes through which abrasive liquid can be sprinkled onto the grinding rollers. The first row of sprinkling holes are formed above and in parallel with the primary grinding rollers slightly upstream from their axes. The second row of sprinkling holes are formed above and in parallel with the secondary grinding rollers slightly upstream from their axes.

The drive rollers may be made of urethane sponge having a urethane hardness between 70 and 90 degrees. The grinding rollers may each include a shaft made of vinyl chloride and a grinding sleeve made of urethane sponge. The sleeve is press-fitted around and adheres to the shaft.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
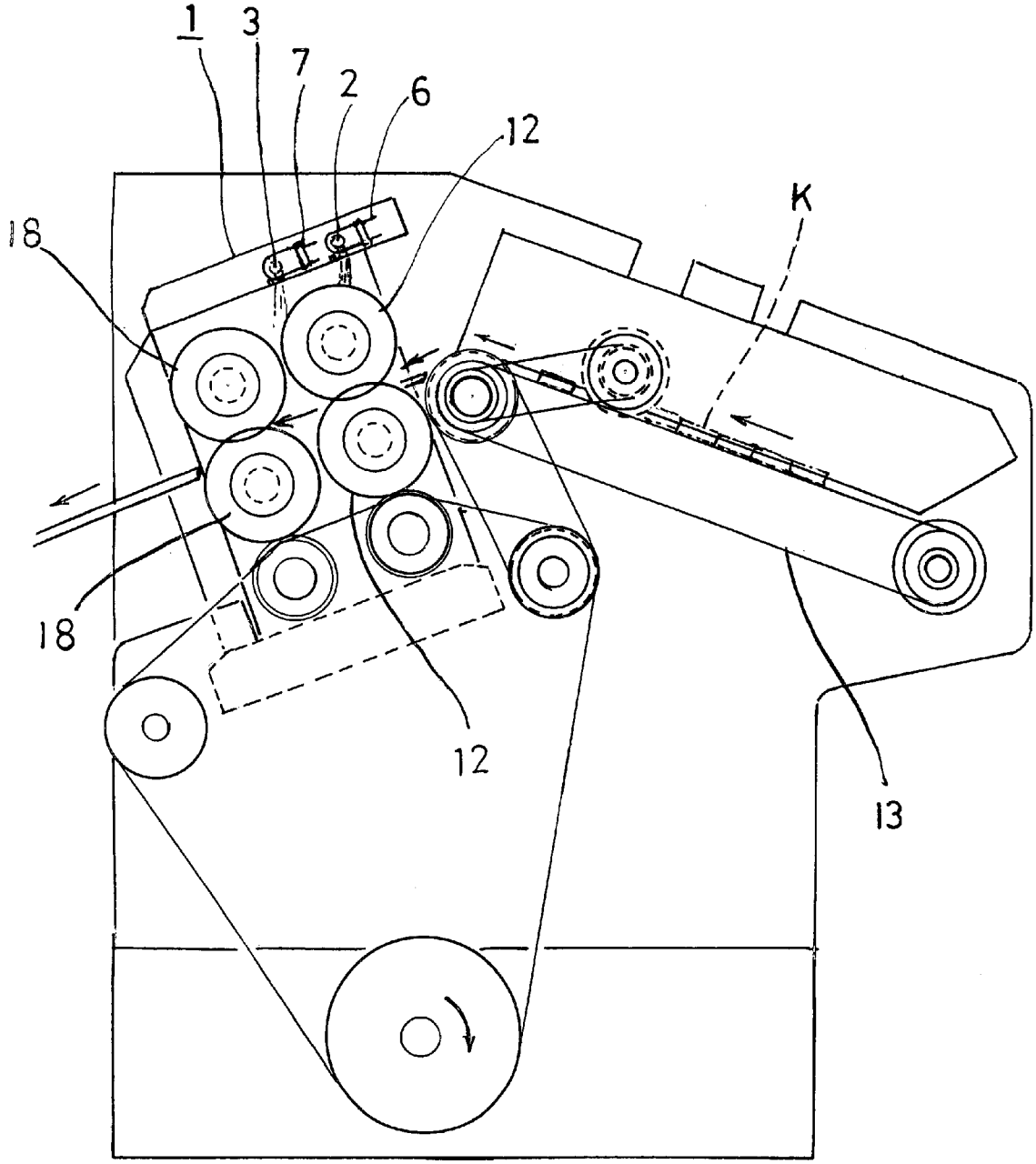
FIG. 1 is a schematic side view of a coin cleaning and grinding apparatus embodying the invention.
Figure 2:
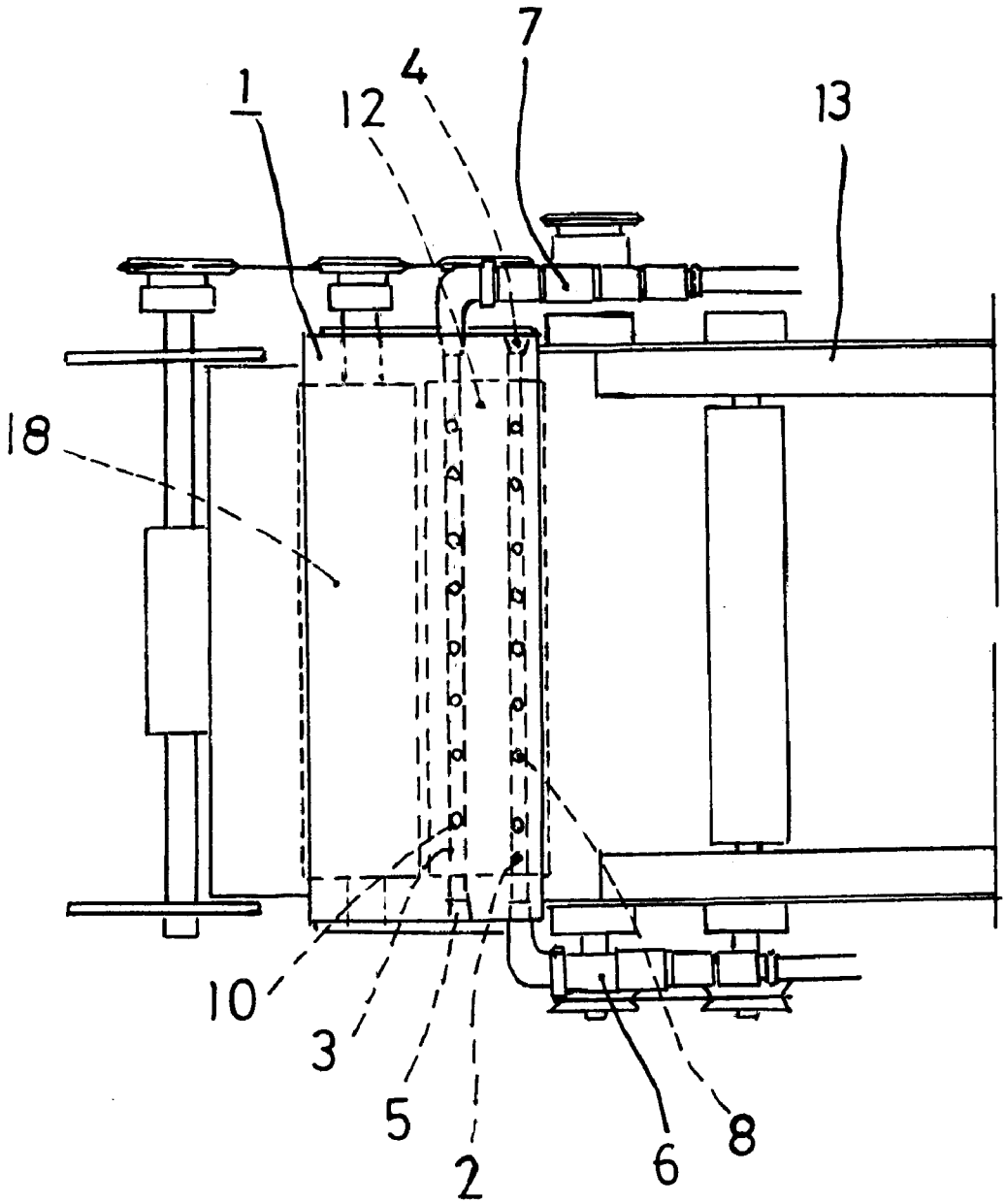
FIG. 2 is a partial top view of the apparatus.

With reference to FIGS. 1 through 4, a sprinkling plate 1 is inclined and positioned above a pair of primary grinding rollers 12 and a pair of secondary grinding rollers 18. The sprinkling plate 1 may be roughly a 120 mm×200 mm rectangular parallelepiped formed steel stock having a thickness of 18 mm. The sprinkling plate 1 has an inner liquid passage 2 and an outer liquid passage 3 that are formed longitudinally and in parallel with each other. The right end of the inner passage 2, as seen in FIG. 2, is closed with a blind plug 4, while the left end is connected through an elbow union to a supply pipe 6. The left end of the outer passage 3 is closed with a blind plug 5, while the right end is connected through an elbow union to a supply pipe 7. The sprinkling plate 1 also has sprinkling holes or orifices 8 and 10 formed in it at regular intervals along the liquid passages 2 and 3, respectively. The sprinkling holes 8 and 10 communicate with the liquid passages 2 and 3, respectively. The sprinkling holes 8 and 10 extend perpendicularly to and open on the underside 9 of the sprinkling plate 1. The sprinkling plate 1 further has drip-prevention grooves 11 formed in its underside 9. Each drip-prevention groove 11 extends in front of one of the liquid passages 2 and 3 and in parallel to them. The drip-prevention grooves 11 are rectangular in vertical section.

Figure 5A:
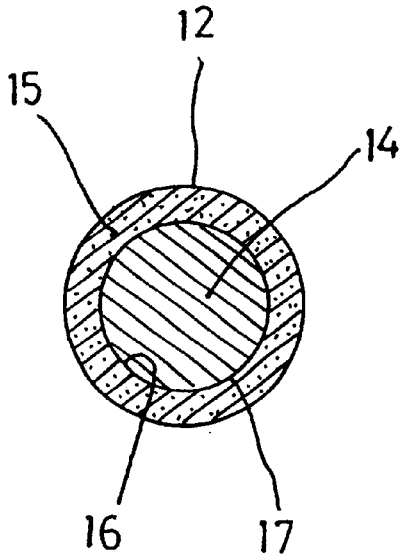
FIGS. 5*a* and 5*b* are enlarged transverse and axial sectional views of one of the primary grinding rollers of the apparatus.
Figure 5B:
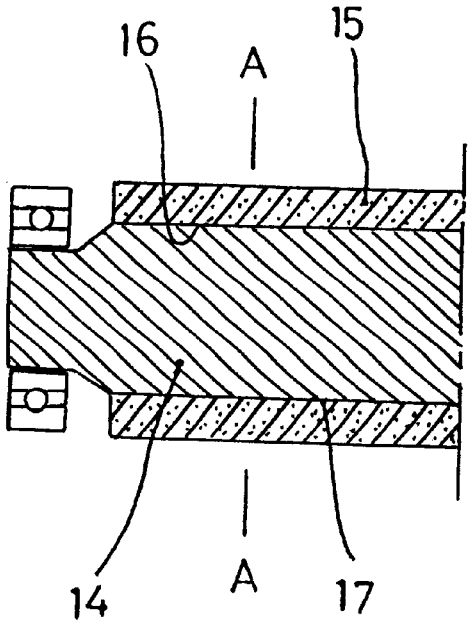

The primary grinding rollers 12 extend horizontally in parallel and are mounted downstream from the front end of a coin conveyor 13 and rotatably in compressive contact with each other. Differently from the prior art, these grinding rollers 12 provide good results if each of the rollers includes a shaft 14 made of vinyl chloride and a grinding sleeve 15 of urethane sponge press-fitted around the shaft, as seen in FIGS. 5*a* and 5*b*.

Specifically, the process for making each grinding roller 12 includes the steps of:

1. making a shaft 14 of vinyl chloride;

2. making a grinding sleeve 15 of urethane sponge, and finishing the inner cylindrical surface 16 of the sleeve so that the inner diameter of the sleeve is 1 to 3 mm smaller than the diameter of the shaft 14;

3. coating the inner cylindrical surface 16 of the grinding roller 15 with primer and removing dust and other foreign substances from this surface;

4. coating the cylindrical surface 17 of the shaft 14 with primer and removing dust and other foreign substances from this surface;

5. coating the cleaned shaft surface 17 with a cyanide adhesive and quickly press-fitting the cleaned sleeve surface 16 on the shaft surface;

6. joining the press-fitted sleeve 15 to the shaft 14 by air drying; and 7. finishing the outer cylindrical surface of the joined sleeve 15 so that the outer diameter of the sleeve is exactly as required of a grinding roller.

Figure 6:
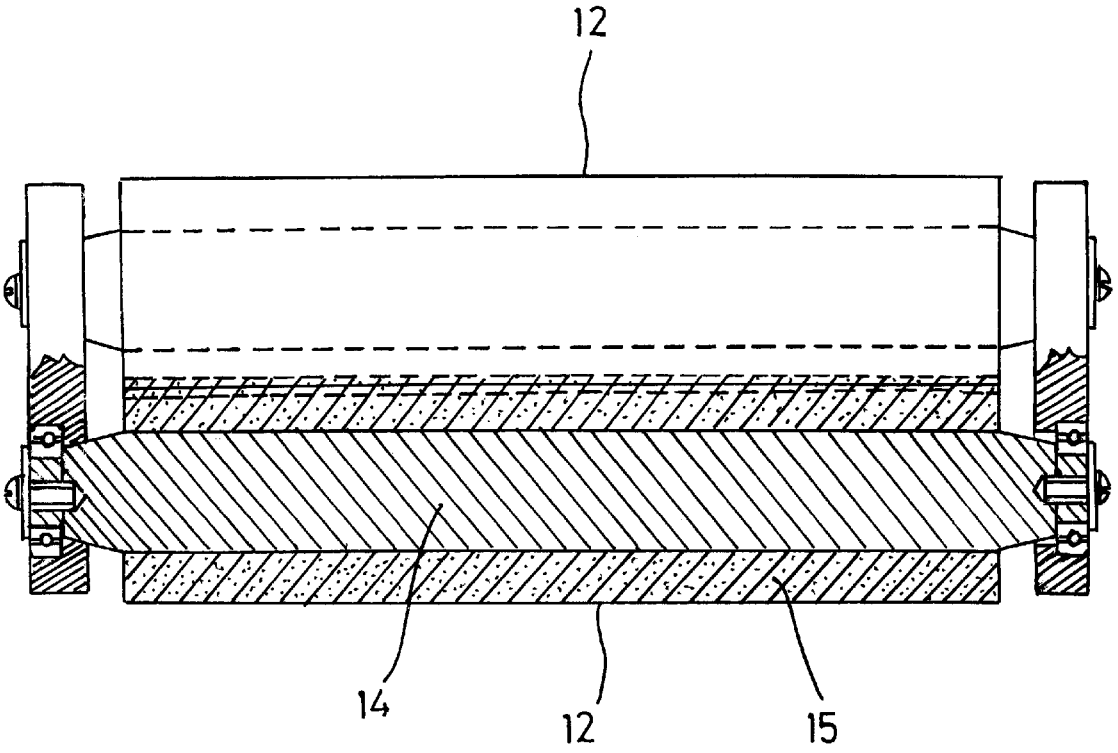
FIG. 6 is an enlarged side view, partially in axial section, of the primary grinding rollers in compressive contact.

The appropriate outer diameter of the grinding sleeves 15 of the primary grinding rollers 12 is closely related to the distance between their axes and to their torque. A torque of about 20 kgf/cm is necessary for rotating the four grinding rollers 12 and 18. In this case, the necessary motor torque is 22 kgf/cm. The pressure between the grinding rollers of each pair is limited to 5 or less kgf/cm per roller. Tests revealed that, when a grinding sleeve 15 of urethane sponge (for example, "RUBYCELL" produced by TOYO POLYMER CO., LTD., Ltd., Japan or polyurethan sponge produced by AION CO., LTD., Japan) was sprinkled with abrasive fluid ("JSB-1" produced by DIANA INDUSTRIES INTERNATIONAL INC., USA), the outer diameter of the sleeve increased by 1 to 2 mm. Accordingly, the distance between the axes of the primary grinding rollers 12 is such that the rollers are in mutual compressive contact with their diameters overlapping each other by 2 mm, as schematically illustrated in FIG. 6. This ensures the roller rotation within an allowable torque range of 20 kgf/cm for the four rollers and an allowable torque range of 10 kgf/cm for each pair of rollers even if their outer diameter increases up to a maximum of 2 mm due to the abrasive fluid.

Figure 3:
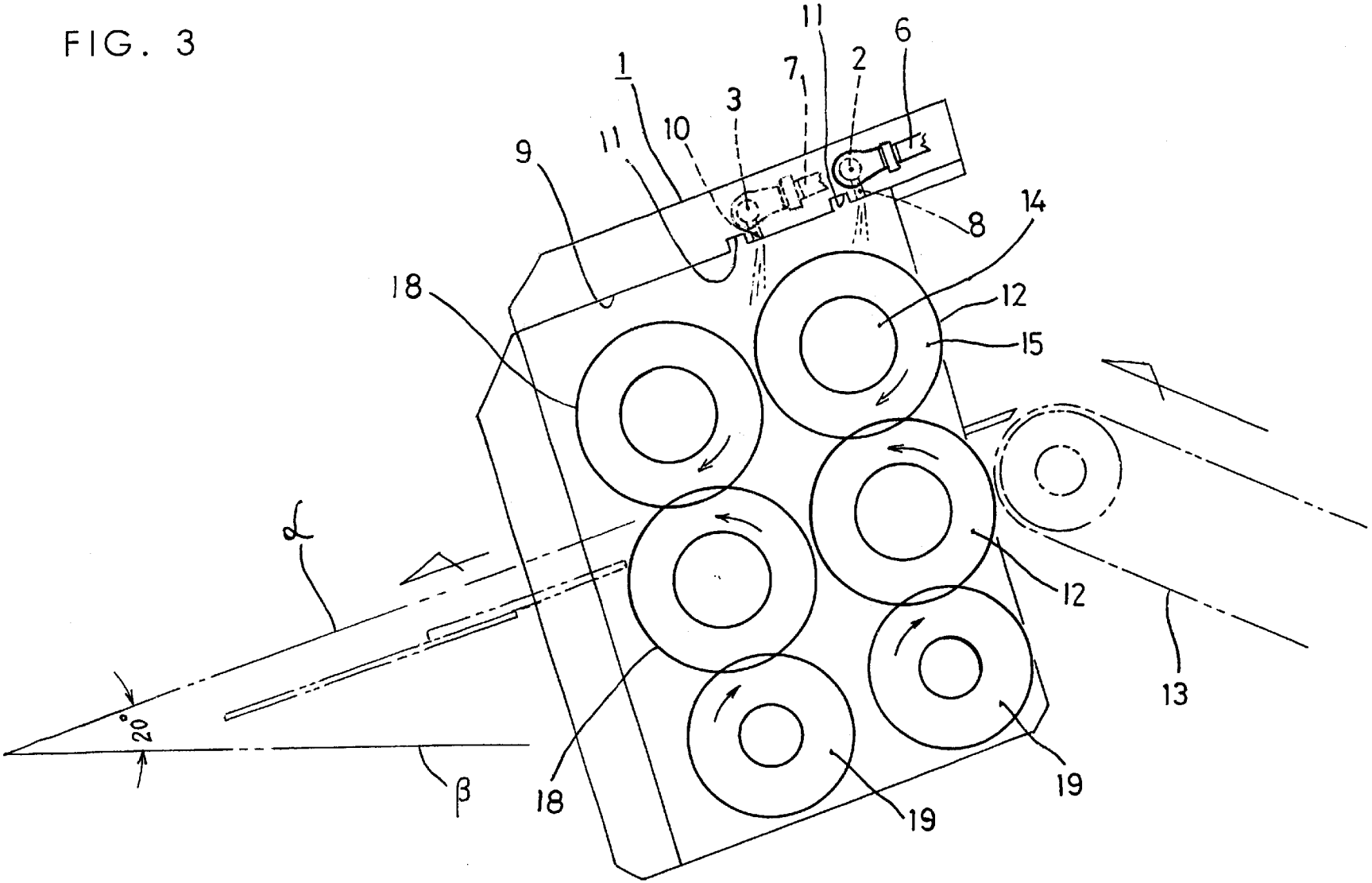
FIG. 3 is an enlarged partial side view of the apparatus.
Figure 4:
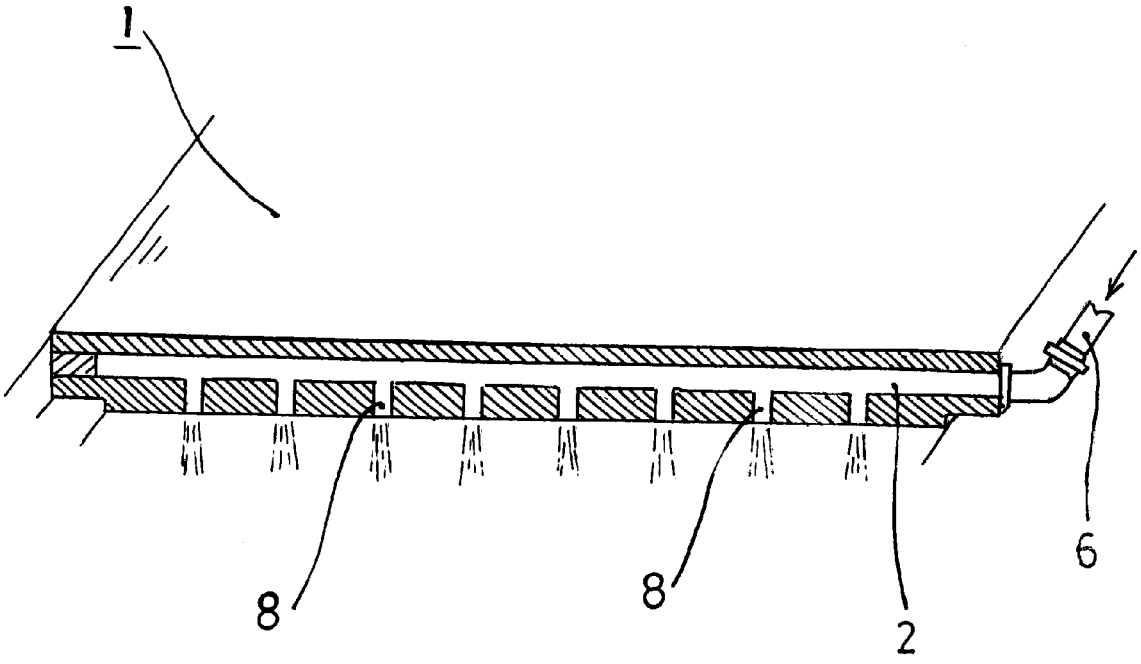
FIG. 4 is an enlarged longitudinal sectional view of the sprinkling plate of the apparatus.

The secondary grinding rollers 18 are produced by the same process and have the same structure as the primary grinding rollers 12. The secondary rollers 18 extend horizontally in parallel and are rotatably mounted downstream from the primary rollers 12. With reference to FIG. 3, the coins pass in a direction $\alpha$ between the primary rollers 12 and between the secondary rollers 18. It is preferable that the angle between the direction $\alpha$ and a horizontal line $\beta$ be 20 degrees. Likewise, the sprinkling plate 1 should preferably extend at an angle of 20 degrees with the horizontal line $\beta$. In this case, the sprinkling holes 8 are positioned over the upper primary roller 12 slightly upstream (backward) from its axis, while the sprinkling holes 10 are positioned slightly upstream from the position between the upper grinding rollers 12 and 18.

Two drive rollers 19 made of urethane having a hardness of between 70 and 90 degrees are provided. Each drive roller 19 is mounted in compressive contact with one of the lower grinding rollers 12 and 18 to drive it.

Figure 7:
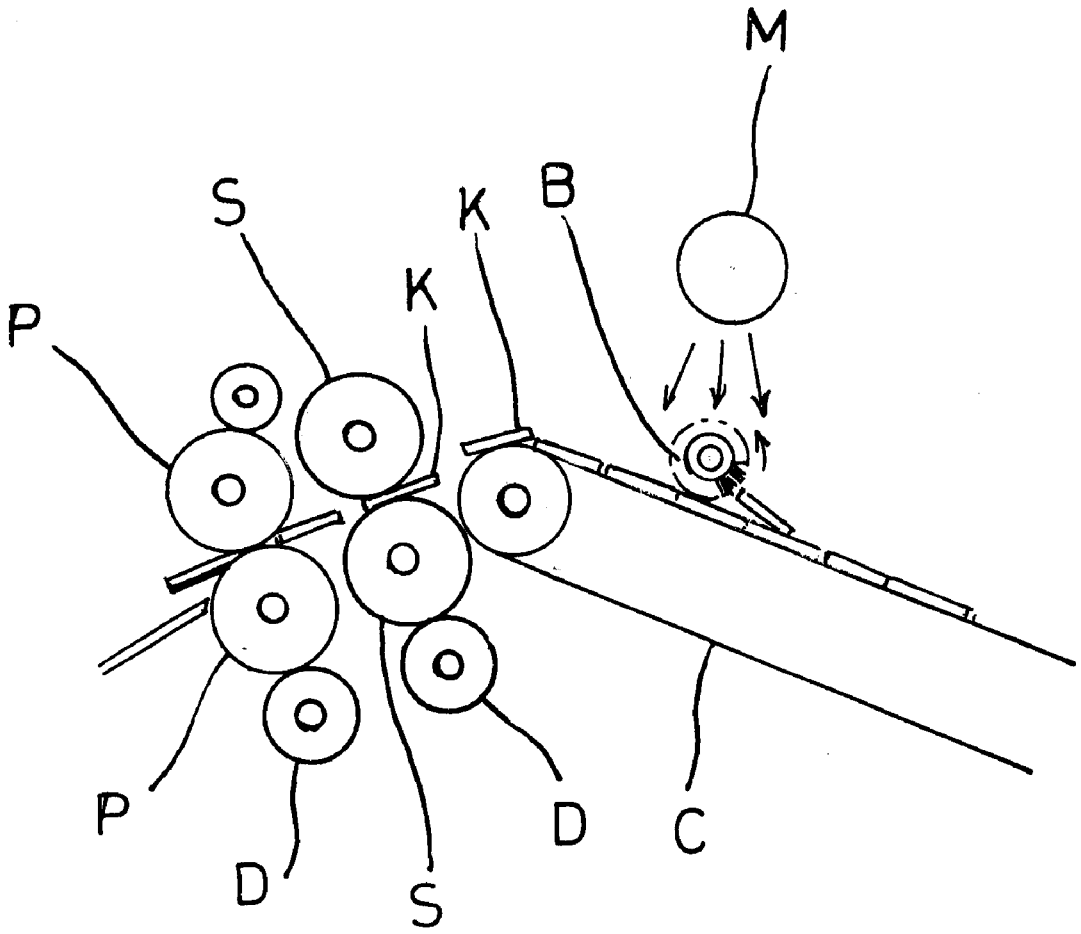
FIG. 7 is a schematic partial side view of a conventional coin cleaning apparatus.

Coins K drop from a hopper (not shown) onto the coin conveyor 13, on which the rotating brush B, shown in FIG. 7, aligns them flush with each other. The aligned coins K are conveyed to the primary grinding rollers 12. In the meantime, a pump (not shown) supplies abrasive liquid from a tank (not shown) to the supply tubes 6 and 7. The supplied liquid is sprinkled from the sprinkling holes 8 and 10 on the grinding rollers 12 and 18. Passing in the sprinkled liquid, the coins K are ground between the primary rollers 12 and between the secondary rollers 18. The ground coins K are discharged from the apparatus.

The best results were achieved by primary grinding rollers 12 and secondary grinding rollers 18 that were made of urethane sponge having a porosity of about 65%.

As described hereinbefore, abrasive liquid is sprinkled from the sprinkling holes of the sprinkling plate tilting over the grinding rollers. While the grinding rollers are cleaned constantly with the sprinkled liquid, the coins are ground. As a result, beautifully ground coins are discharged from the apparatus. The use of the abrasive liquid prevents the discharged coins from rusting.

While specific embodiments of the invention have been described in detail to illustrate the inventive principles, it will be understood that the invention may be embodied otherwise without departing from such principles.

I claim:

1. A coin cleaning and grinding apparatus comprising:

a conveyor for conveying coins having a discharge end;

first and second drive rollers supported rotatably and horizontally in parallel with each other;

a pair of first and second primary cleaning/processing rollers mounted rotatably and downstream from the discharge end of the conveyor, the primary cleaning/processing rollers extending in parallel with the drive rollers, the first primary cleaning/processing rollers being positioned lower than the second primary cleaning/processing roller, the second primary cleaning/processing roller being in compressive contact with the first primary cleaning/processing roller and the first drive roller;

a pair of first and second secondary cleaning/processing rollers supported rotatably and downstream from the primary cleaning/processing rollers, the secondary cleaning/processing rollers extending in parallel with the drive rollers, the first secondary cleaning/processing rollers being positioned lower than the second secondary cleaning/processing roller, the first secondary cleaning/processing roller being in compressive contact with the second secondary cleaning/processing roller and the second drive roller; and a sprinkling plate positioned at an angle above the primary and secondary cleaning/processing rollers;

the sprinkling plate having first and second rows of sprinkling holes for sprinkling abrasive liquid onto the cleaning/processing rollers, the first row being formed above and in parallel with the primary cleaning/processing rollers upstream from axes of the primary rollers, the second row being formed above and in parallel with the secondary cleaning/processing rollers upstream from axes of the secondary rollers.

2. The cleaning and grinding apparatus according to claim 1, wherein the sprinkling plate has first and second drip-prevention grooves formed in an underside thereof, the first and second grooves extending along and downstream from the first and second rows of sprinkling holes, respectively, and wherein the grooves are rectangular in vertical section.

3. The cleaning and grinding apparatus according to claim 1, wherein the cleaning/processing rollers each include a shaft of vinyl chloride and a grinding sleeve made of urethane sponge, the sleeve being press-fitted around and adhering to the shaft.

4. The cleaning and grinding apparatus according to claim 1, wherein the drive rollers are made of urethane sponge having a urethane hardness of between 70 and 90 degrees.

* * * * *